United States Patent [19]

Kroontje et al.

[11] Patent Number: 4,940,923

[45] Date of Patent: Jul. 10, 1990

[54] ELECTRODELESS LOW-PRESSURE DISCHARGE LAMP

[75] Inventors: Wiggert Kroontje; Willem J. van den Bogert, both of Eindhoven, Netherlands

[73] Assignee: U.S. Philips Corporation, New York, N.Y.

[21] Appl. No.: 442,494

[22] Filed: Nov. 27, 1989

Related U.S. Application Data

[63] Continuation of Ser. No. 202,769, Jun. 3, 1988, abandoned.

[30] Foreign Application Priority Data

Jun. 5, 1987 [NL] Netherlands ..... 8701315

[51] Int. Cl.[5] ..... H05B 41/16

[52] U.S. Cl. ..... 315/248; 315/344; 313/493

[58] Field of Search ..... 315/85, 248, 344; 313/492, 493

[56] References Cited

U.S. PATENT DOCUMENTS 4,568,859 2/1986 Houkes et al. ..... 315/248

FOREIGN PATENT DOCUMENTS 53-4382 1/1978 Japan .

*Primary Examiner*—Robert J. Pascal

*Attorney, Agent, or Firm*—Brian J. Wieghaus

[57] ABSTRACT

Electrodeless low-pressure discharge lamp having a lamp vessel which is sealed in a gas-tight manner and which is filled with a metal vapor and a rare gas and which has a core of a magnetic material. During operation of the lamp an electric field is generated in the lamp vessel by means of a winding surrounding the core and a high-frequency supply unit connected thereto. A transparent electrically conducting layer is present on the inside of the lamp vessel, and is connected to an electric conductor located outside the lamp vessel by means of a lead-through member incorporated in the wall of the lamp vessel. The lead-through member is electrically connected to a contact strip of conducting material extending on at least the greater part of the circumference on the inside of the lamp vessel and is electrically connected substantially throughout its length to the transparent conducting layer.

16 Claims, 1 Drawing Sheet

ELECTRODELESS LOW-PRESSURE DISCHARGE LAMP

This is a continuation of application Ser. No. 202,769, filed June 3, 1988, now abandoned.

BACKGROUND OF THE INVENTION

The invention relates to an electrodeless low-pressure discharge lamp having a lamp vessel which is sealed in a gas-tight manner and which is filled with a metal vapor and a rare gas, and has a core of a magnetic material. During operation of the lamp, an electric field is generated in the lamp vessel by means of a winding surrounding the core and a high-frequency supply unit connected thereto. A transparent electrically conducting layer is present on the inside of the lamp vessel which is connected to an electric conductor located outside the lamp vessel by means of a lead-through member incorporated in the wall of the lamp vessel. A lamp of this type is known from Japanese Kokai No. 53-4382 (Application No. 51-78660).

In the known lamp the inside of the lamp vessel has a transparent conducting layer in order to prevent high-frequency electric interference currents from being produced in the mains. The conducting layer is connected to a rod-shaped lead-through member which is incorporated in the wall of the lamp vessel. It has been found that it is advantageous to connect the said conducting layer to one of the supply wires of the mains so as to reduce the said interference currents as described in U.S. Pat. No. 4,568,859.

To comply with the standards imposed with respect to the maximum admissible value of the interference, the said conducting layer should be relatively thick. This is a drawback, because it has a negative influence on the light output of the lamp. Moreover, it is troublesome and costly to provide such a comparatively thick layer.

SUMMARY OF THE INVENTION

It is an object of the invention to provide an electrodeless low-pressure discharge lamp obviating the above-mentioned drawbacks and complying with the standards on interference.

According to the invention an electrodeless low-pressure discharge lamp of the type described in the opening paragraph is therefore characterized in that the lead-through member is electrically connected to a contact member of conducting material extending on at least the greater part of the circumference on the inside of the lamp vessel and being electrically connected substantially throughout its length to the transparent conducting layer.

The contact member is preferably connected via an electric conductor to one of the supply wires of the mains. It has been found that the high-frequency electric interference on the mains is reduced to a value which is amply below the prevailing standard. This is due to the fact that substantially the entire length of the contact member is in electrical contact with the transparent conducting layer. It has been found that the interference suppression is many times better in comparison with an electric contact which is realized at only one single location (as in the lamp described in the above-mentioned Japanese Patent Application). By using the contact member, the thickness of the transparent conducting layer can be reduced considerably. This contributes to the light output of the lamp. In a practical embodiment the contact member is a strip of conducting material. This strip and the transparent layer can easily be provided on each other. The strip is located in the immediate proximity of the lead-through member which is located on the lower side of the lamp vessel in the proximity of the location where the lamp vessel is sealed by a sealing member. At said location the lamp vessel generally has a cylindrical portion so that the strip is actually annular. In low-pressure mercury vapor discharge lamps, a luminescent layer is often provided on the said transparent layer in order to convert ultraviolet radiation generated in the mercury discharge into visible light.

The use of the said conducting strip has also the advantage that a reliable connection is obtained in a simple manner with a lead-through member (for example, consisting of a wire of an alloy of chromium, iron and nickel incorporated in the wall of the lamp vessel).

The strip preferably comprises aluminum. Compared with other metals this material can be relatively simply provided on the inside of the lamp vessel by means of a vapor deposition process.

In another embodiment, the contact member is a wire bearing against the transparent conducting layer. Such an annular wire can easily be provided during manufacture. Possible auxiliary members (such as a holder for an amalgam) may also be secured on the wire. The wire is located, for example, in a groove in the wall of the lamp vessel. The wire then correctly stays in place and ensures a reliable electrical contact with the conducting layer. This is particularly the case if the wire consists of a resilient material.

In a special embodiment the lead-through member is incorporated in a gas-tight manner in the end of the exhaust tube of the sealing member with which the lamp vessel is sealed, the end of the lead-through member being secured to the contact member.

When manufacturing the lamp the lead-through member can be simply secured to the end of the exhaust tube. The lead-through member is, for example, in the form of a wire of an alloy of chromium, iron and nickel whose end is fused with the contact strip.

The lamp according to the invention is, for example, a luminescent electrodeless low-pressure mercury vapor discharge lamp. Such a lamp is used as an alternative to an incandescent lamp for general illumination purposes.

The invention will now be described in greater detail by way of example with reference to the accompanying drawing in which

DESCRIPTION OF THE PREFERRED EMBODIMENT

Figure 1:
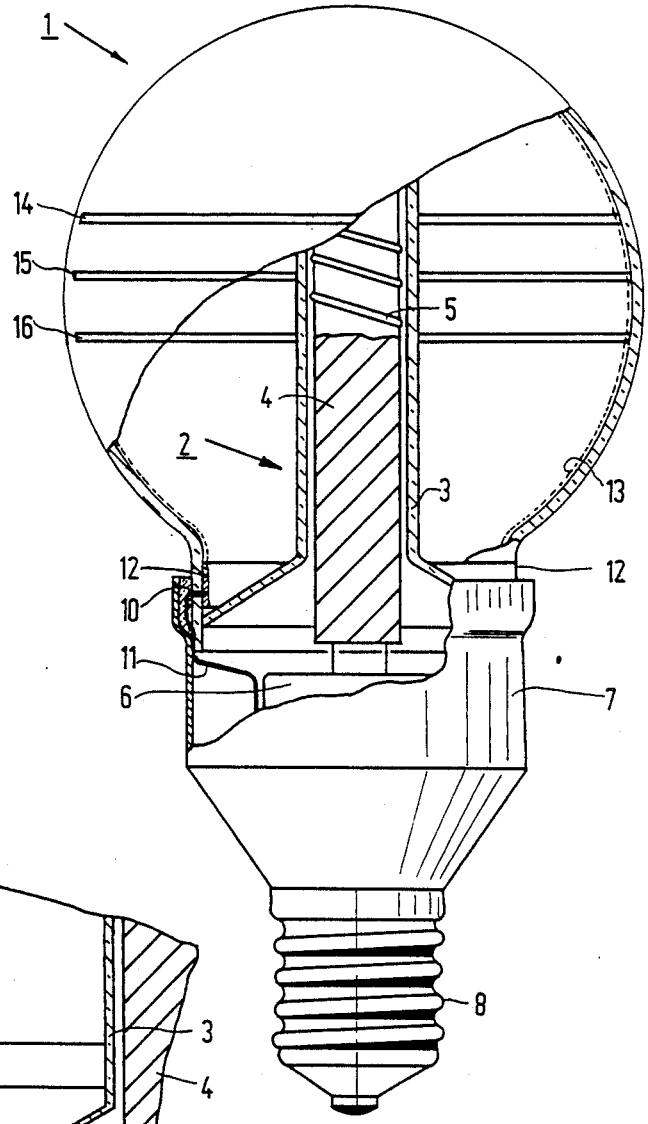
FIG. 1 shows partly in an elevational view, partly in a longitudinal section an embodiment of an electrodeless low-pressure mercury vapor discharge lamp according to the invention.

The lamp of FIG. 1 has a glass bulb-shaped lamp vessel 1 which is filled with mercury and a rare gas (such as argon, pressure 70 1*a*). The lamp vessel is sealed in a gas-tight manner by means of a glass sealing member 2 having a tubular indentation 3 accommodating a rod-shaped core 4 of a magnetic material such as ferrite. A winding 5 which is connected to a high-frequency electric supply unit 6 is provided around the core 4, which unit is located in a partly cylindrical thin-walled synthetic material portion 7 which is cemented to the lamp vessel and whose end has a lamp cap 8. During operation of the lamp a high-frequency electric field is generated in the lamp vessel.

The lamp vessel 1 of the lamp incorporates a wire-shaped or pin-shaped metal lead-through member 10. This lead-through member 10 is connected via conductor 11 to the lamp cap 8. When placing the lamp in a holder, the connection with one of the supply wires of the mains is established. The lead-through member 10 is also connected to a contact strip 12 of conducting material such as aluminium. This strip is present on the inside of the neck of the bulb-shaped lamp vessel and extends as a ring on the circumference of the said lamp vessel. (This ring need not necessarily be closed.) Throughout its length the contact strip is in electrical contact with the transparent conducting layer 13 which extends on substantially the entire inner surface of the bulb-shaped lamp vessel. This layer is shown in broken lines in the drawing.

The lead-through member 10 comprises an alloy of chromium, iron and nickel and is secured in the wall by means of sealing glass. The said alloy has a coefficient of expansion which satisfactorily corresponds to that of glass.

Due to the connection with one of the supply wires of the mains, the high-frequency electric interference on the mains is reduced to below the prevailing standard during operation of the lamp.

Furthermore, the inside of the lamp vessel is provided with three conducting rings 14, 15 and 16 of aluminium enclosing the discharge. Due to the presence of these rings the lamp is prevented from functioning as a magnetic interference source as a result of which interference currents are induced in the mains.

These rings are formed by firstly providing a relatively broad strip of aluminium (thickness approximately 2 μm) on the entire circumference on the inside of the lamp vessel by means of a vapor deposition process and by partly removing said strip by means of a laser beam from the outside so that the said rings are obtained. The transparent conducting layer is subsequently provided.

Figure 2:
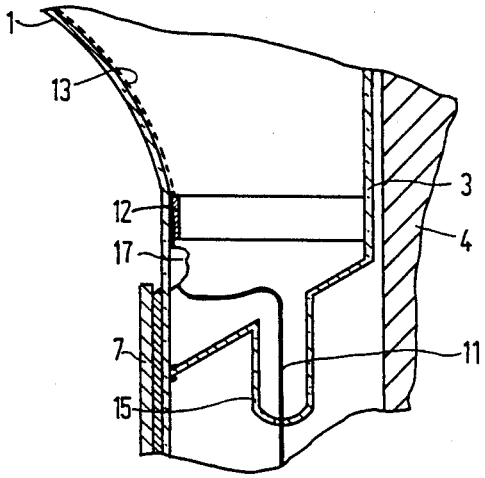
FIG. 2 is a cross-section of a detail of another embodiment of the lamp according to the invention.

In the embodiment of FIG. 2 the same components as in FIG. 1 have the same reference numerals. The wire-shaped lead-through member 14 is incorporated in the end of exhaust tube 15 which is secured in the sealing member. The end of the wire is electrically connected to the conducting strip. At some distance from said connection point the wire 14 is secured to the wall of the lamp vessel 1 by means of a glass bead 17. The electric connection between 14 and 12 is subjected to a minimum possible mechanical load.

In a practical embodiment, the lamp described has a power of approximately 17 Watts and a light output of approximately 1200 lumens. The external diameter of the discharge vessel was approximately 7 cm, the length of the entire lamp was approximately 15 cm. The strip 12 had a width of approximately 5 mm, whilst the length measured throughout the circumference was approximately 12 cm. It was found that the interference suppression by the contact of the strip 12 with the conducting layer 13 on its entire circumference was 12 dB μV lower than in a lamp with a connection in which the lead-through member was connected to the conducting layer 13 at one single location.

The lamp vessel of the lamp had a luminescent layer provided on the layer 13 and comprising a mixture of a green-luminescing terbium-activated cerium magnesium aluminate phosphor and a red-luminescing yttrium oxide phosphor activated by trivalent europium. The layer 13 was provided by deposition on the wall of a solution comprising tin chloride and a small quantity of ammonium fluoride in butyl acetate. The subsequently formed layer of fluorine-doped tin oxide had a thickness of 0.4 μm and a resistance per square of approximately 20 Ohm. The operating frequency of the lamp was 2.65 MHz.

What is claimed is:

1. An electrodeless low-pressure discharge lamp having a lamp vessel sealed in a gas tight manner, a fill within said lamp vessel comprising metal vapor and a rare gas, said lamp vessel having an outer wall and an inner wall defining a core of said lamp, means disposed in said core for generating a high frequency electric field for exciting said gas fill and producing light, and a transparent electrically conducting layer disposed on the inner surface of said outer wall, wherein the improvement comprises:

a conductive contact member electrically connected to said transparent conducting layer along the major part of the circumference of said inside surface of said outer wall, and a conductive lead-through extending through said lamp vessel and connected to said conductive contact member.

2. An electrodeless low-pressure discharge lamp as claimed in claim 1, characterized in that the contact member is a strip of conducting material.

3. An electrodeless low-pressure discharge lamp as claimed in claim 2, characterized in that the contact strip comprises aluminum.

4. An electrodeless low-pressure discharge lamp as claimed in claim 1, characterized in that the contact member is a wire bearing against the transparent conducting layer.

5. An electrodeless low-pressure discharge lamp as claimed in claim 4, characterized in that the lamp vessel comprises a groove having said transparent conductive layer and said wire is disposed in said groove.

6. An electrodeless low-pressure discharge lamp as claimed in claim 5, characterized in that the wire consists of a resilient material.

7. An electrodeless low-pressure discharge lamp as claimed in claim 6, characterized in that an exhaust tube having a sealed end seals said lamp vessel, and said lead-through extends through said sealed end in a gas-tight manner, the end of the lead-through being secured to the contact member.

8. An electrodeless low-pressure discharge lamp as claimed in claim 7, characterized in that the lead-through member is secured to the inside of the lamp vessel at a location at some distance from the point of connection with the contact member.

9. An electrodeless low-pressure discharge lamp as claimed in claim 4, characterized in that the wire consists of a resilient material.

10. An electrodeless low-pressure discharge lamp as claimed in claim 9, characterized in that an exhaust tube having a sealed end seals said lamp vessel, and said lead-through extends through said sealed end in a gas-tight manner, the end of the lead-through being secured to the contact member.

11. An electrodeless low-pressure discharge lamp as claimed in claim 5, characterized in that an exhaust tube having a sealed end seals said lamp vessel, and said lead-through extends through said sealed end in a gas-tight manner, the end of the lead-through being secured to the contact member.

12. An electrodeless low-pressure discharge lamp as claimed in claim 4, characterized in that an exhaust tube having a sealed end seals said lamp vessel, and said lead-through extends through said sealed end in a gas-tight manner, the end of the lead-through being secured to the contact member.

13. An electrodeless low-pressure discharge lamp as claimed in claim 3, characterized in that an exhaust tube having a sealed end seals said lamp vessel, and said lead-through extends through said sealed end in a gas-tight manner, the end of the lead-through being secured to the contact member.

14. An electrodeless low-pressure discharge lamp as claimed in claim 2, characterized in that an exhaust tube having a sealed end seals said lamp vessel, and said lead-through extends through said sealed end in a gas-tight manner, the end of the lead-through being secured to the contact member.

15. An electrodeless low-pressure discharge lamp as claimed in claim 1, characterized in that an exhaust tube having a sealed end seals said lamp vessel, and said lead-through extends through said sealed end in a gas-tight manner, the end of the lead-through being secured to the contact member.

16. An electrodeless low-pressure discharge lamp as claimed in claim 2, wherein said means for generating a high frequency electric field comprises a rod of magnetic material disposed in said core, a length of wire coiled around said core, and a high frequency power supply unit external to said lamp and electrically connected to said coil.

* * * * *